US007032371B2

(12) United States Patent
Smith et al.

(10) Patent No.: US 7,032,371 B2
(45) Date of Patent: Apr. 25, 2006

(54) SYNTHETIC FIBER ROPE FOR AN ELEVATOR

(75) Inventors: Rory Smith, El Cajon, CA (US); John L. Fite, Jr., Germantown, TN (US); Harry Simpkins, Memphis, TN (US); Roy J. Walker, Bartlett, TN (US); Alan Sanford Koralek, Midlothian, VA (US); A. Simeon Whitehill, West Chester, PA (US); Mark G. Huntley, Boothwyn, PA (US); Philip T. Gibson, Los Alamitos, CA (US)

(73) Assignee: Thyssen Elevator Capital Corp., Whittier, CA (US)

( * ) Notice: Subject to any disclaimer, the term of this patent is extended or adjusted under 35 U.S.C. 154(b) by 12 days.

(21) Appl. No.: 10/354,378

(22) Filed: Jan. 30, 2003

(65) Prior Publication Data

US 2003/0226347 A1 Dec. 11, 2003

Related U.S. Application Data

(60) Provisional application No. 60/353,020, filed on Jan. 30, 2002.

(51) Int. Cl.
*D02G 3/02* (2006.01)

(52) U.S. Cl. ..... 57/237

(58) Field of Classification Search ..... 57/211, 57/236, 237

See application file for complete search history.

(56) References Cited

U.S. PATENT DOCUMENTS

| | | | | | |
|---|---|---|---|---|---|
| 825,748 | A | * | 7/1906 | Muhlstephan | 57/211 |
| 2,343,892 | A | * | 3/1944 | Dodge et al. | 57/237 |
| 2,971,321 | A | * | 2/1961 | Himmelfarb et al. | 57/237 |
| 3,016,682 | A | * | 1/1962 | Gaston | 57/237 |
| 3,383,849 | A | * | 5/1968 | Stirling | 57/211 |
| 3,395,529 | A | * | 8/1968 | Ray | 57/237 |
| 3,415,052 | A | * | 12/1968 | Stanton | 57/231 |
| 3,839,854 | A | | 10/1974 | Carranza et al. | 57/140 R |
| 4,022,010 | A | | 5/1977 | Gladenbeck et al. | 57/149 |
| 4,321,854 | A | | 3/1982 | Foote et al. | 87/6 |
| 4,466,331 | A | | 8/1984 | Matheson | 87/12 |
| 4,550,559 | A | * | 11/1985 | Thomson | 57/223 |
| 4,624,097 | A | | 11/1986 | Wilcox | 57/232 |
| 4,790,802 | A | | 12/1988 | Onoe et al. | 474/260 |
| 4,887,422 | A | | 12/1989 | Klees et al. | 57/220 |
| 5,165,993 | A | | 11/1992 | van Anholt et al. | 428/364 |
| 5,566,786 | A | | 10/1996 | De Angelis et al. | 187/266 |
| 5,651,245 | A | | 7/1997 | Damien | 57/220 |
| 5,834,942 | A | | 11/1998 | De Angelis | 324/522 |
| 5,881,843 | A | | 3/1999 | O'Donnell et al. | 187/254 |
| 6,164,053 | A | | 12/2000 | O'Donnell et al. | 57/232 |

(Continued)

FOREIGN PATENT DOCUMENTS

JP 2002-60162 A 2/2002

*Primary Examiner*—Shaun R. Hurley
(74) *Attorney, Agent, or Firm*—Frost Brown Todd LLC

(57) ABSTRACT

A synthetic rope for an elevator having improved resistance to compression and abrasion is provided and comprises a plurality of strands forming layers of the rope, each strand formed from a plurality of pre-twisted strands made from high modulus synthetic filaments. One or more of the strands or layers of strands may be impregnated with a lubricant, such as polytetrafluoroethylene, to reduce the abrasion among the strands and substrands, and increase the service life of the rope. The exterior of the rope may be covered by a jacket that provides for traction with the drive sheave. An elevator system comprising the claimed rope is also provided.

15 Claims, 7 Drawing Sheets

U.S. PATENT DOCUMENTS 6,314,711 B1 11/2001 De Angelis ..... 57/210
6,318,504 B1 11/2001 De Angelis ..... 187/254
6,321,520 B1 11/2001 De Angelis ..... 57/223
6,508,051 B1 1/2003 De Angelis ..... 57/223

* cited by examiner

SYNTHETIC FIBER ROPE FOR AN ELEVATOR

This application claims priority to U.S. provisional patent application Ser. No. 60/353,020, filed Jan. 30, 2002, the disclosure of which is incorporated herein in its entirety.

BACKGROUND OF THE INVENTION

1. Field of the Invention

The present invention generally concerns ropes for elevators. In particular, the invention concerns a rope formed from high modulus synthetic fibers for use in elevator systems that employ traction sheaves to drive the rope and the elevator car connected to the rope. The ropes of the invention have an improved structure that reduces compression and abrasion deterioration over the life of the rope.

2. Description of Related Art

Conventional traction drive elevators employ an elevator car that is suspended by a rope in a hoistway. The rope typically extends upwardly to the top of the elevator shaft over a drive sheave and other sheaves and then back down the shaft to a counterweight. The drive sheave and the rope are in friction contact so that the rotation of the drive sheave displaces the rope and consequently raises or lowers the elevator car.

Prior art traction elevators have traditionally used steel wire ropes to drive the elevator. Steel ropes are relatively inexpensive and durable, but they are heavy. For high rise applications, the rope must be very long and the resulting weight of a steel rope must be offset with a compensating rope of similar weight (and a tensioning device) hanging from the underside of the car and counterweight. The combined weight of the car and rope often surpasses the tensile strength of the rope and consequently requires the use of additional ropes.

The prior art has developed a number of ropes from synthetic materials in an effort to replace steel ropes used in traction drive elevators. Examples of synthetic ropes are found in U.S. Pat. Nos. 6,508,051 to De Angelis, issued Jan. 21, 2003; 6,321,520 to De Angelis, issued Nov. 27, 2001; 6,318,504 to De Angelis, issued Nov. 20, 2001; 6,314,711 to De Angelis, issued Nov. 13, 2001; 6,164,053 to O'Donnell et al., issued Dec. 26, 2000; 5,881,843 to O'Donnell et al., issued Mar. 16, 1999; 5,834,942 to De Angelis, issued Nov. 10, 1998; 5,566,786 to De Angelis et al., issued Oct. 22, 1996; 5,651,245 to Damien, issued Jul. 29, 1997; 4,887,422 to Klees et al., issued Dec. 19, 1989; and 4,624,097 to Wilcox, issued Nov. 25, 1986.

The synthetic ropes developed thus far, however, have not adequately addressed the problems that arise from the use of synthetic materials. Synthetic ropes have at least two failure modes, namely compression and abrasion. The prior art synthetic ropes have attempted to address these two problems by constructing the ropes from a series of helically wound layers of fiber strands and placing intersheaths (typically constructed of polyurethane) between the layers. These attempts have not adequately solved the compression and abrasion problems that shorten the service life of the ropes. In addition, the use of intersheaths requires additional steps in the manufacturing process for such ropes and undesirably increases the elasticity of the rope, which can cause the elevator car to bounce as passengers enter and exit the car.

It would therefore be desirable to provide a light weight rope for elevators made from a synthetic material having improved resistance to compression and abrasion, and which removes the need for intersheaths in the construction of the rope.

SUMMARY OF THE INVENTION

The invention provides a synthetic rope for an elevator having improved resistance to compression and abrasion. The ropes of the invention have particular use in traction drive elevator systems. The inventive rope comprises a plurality of helically laid strands, each strand formed from a plurality of helically laid pre-twisted substrands. The term "pre-twisted substrands" means that each substrand is composed of a plurality of yarns that have been combined by utilizing one or more twisting steps. For example, in a first twisting step, a yarn (composed of a plurality of synthetic filaments) is twisted in a first direction. In a subsequent twisting step, a plurality of such yarns are then twisted around one another in a second direction. The second direction may be the same as or opposite from the first direction. In an alternative embodiment, a plurality of yarns may be twisted around one another in a single step.

The yarns comprise a plurality of synthetic filaments that are constructed of high modulus synthetic filaments, such as filaments comprising an aramid polymer sold under the trademark KEVLAR® and more preferably from KEVLAR® 29 or KEVLAR® 49 (KEVLAR® is a trademark of E. I. du Pont de Nemours and Company). A plurality of the pre-twisted substrands are then combined to form each strand. One or more of the strands or substrands may be impregnated or coated with a lubricant to reduce the abrasion among the strands and increase the service life of the rope. The exterior of the rope may then be covered by an outer jacket that provides for traction with the drive sheave.

In one embodiment, the rope comprises an inner, middle and outer layers of strands. Each strand comprises a plurality of pre-twisted substrands that are composed of yarns, each yarn comprised of a plurality of synthetic filaments. Each substrand is pre-twisted and then a plurality of substrands are helically laid around one another to form each strand. In this embodiment, the inner layer comprises three strands laid helically around one another and may be impregnated with particles of a lubricant. The lubricant comprises polytetrafluoroethylene (PTFE). In this particular embodiment, the inner layer is dipped into an aqueous dispersion of PTFE and then dried so the PTFE takes the form of fine dried particles. The middle layer comprises six strands laid helically around the inner layer. The outer layer comprises twelve strands laid helically around the middle layer. Each strand of the middle and outer layers is also formed from a plurality of pre-twisted substands that are helically laid around one another. The middle and outer layers may optionally be impregnated with lubricant (such as PTFE). Finally, an exterior jacket maybe used to cover the outer layer of strands. The exterior jacket may include synthetic fibers such as polyester or nylon. In one embodiment, the outer jacket is composed of CORDURA® nylon fibers (CORDURA® is a trademark of E. I. du Pont de Nemours and Company), which has been braided over the outer layer of strands in a crosshatch pattern.

The density of the claimed rope is significantly lower than that of steel, enabling smaller drive motors to be placed within the elevator shaft instead of in a separate machine room. Furthermore, a drive sheave to move a half-inch diameter rope according to the invention can be significantly smaller, for example, 10.5 inches in diameter, as compared to sheaves used for half-inch steel ropes which are a minimum of 20 inches in diameter. The smaller sheaves help to reduce the overall space needed to operate the elevator and to reduce the required torque of the motor.

DETAILED DESCRIPTION OF THE INVENTION

Several embodiments of the claimed invention will now be described with reference to the Figures, wherein like numerals designate like elements.

Figure 1:
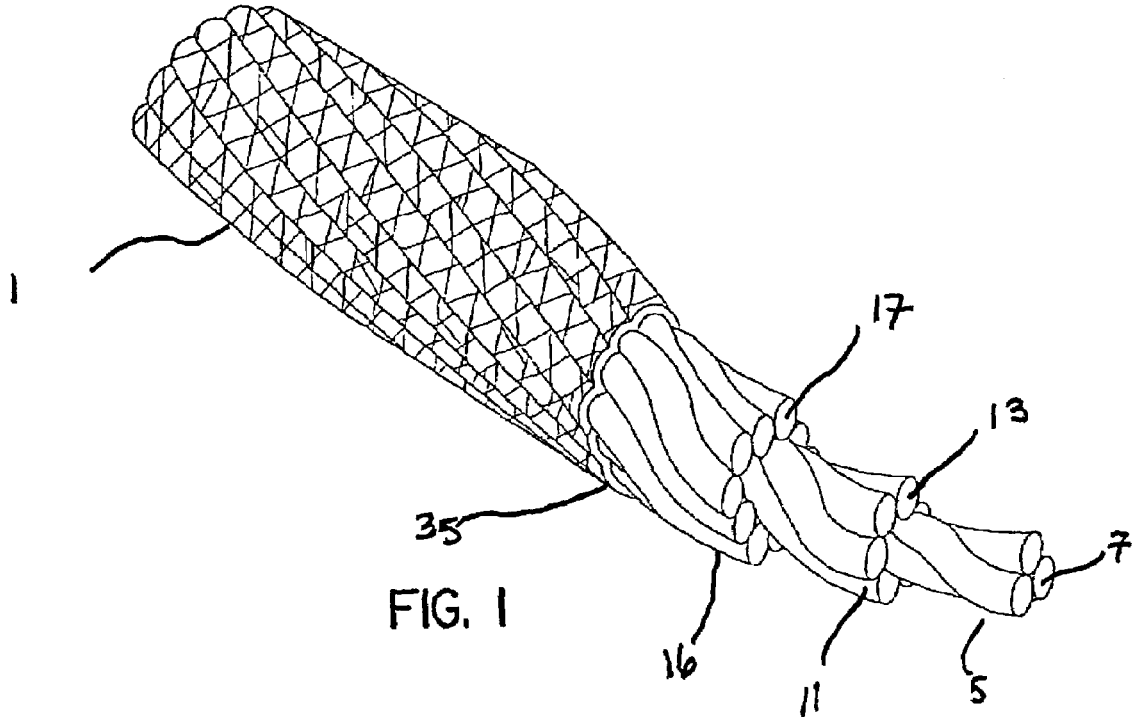
FIG. 1 is a perspective view of a rope according to the invention.

Referring to FIG. 1, showing one embodiment of the invention, the rope 1 includes an inner layer 5, a middle layer 11, an outer layer 16 and a jacket 35. The inner layer 5 contains three strands 7 wrapped around one another in a helical orientation. The middle layer 11 contains six strands 13 wrapped around the inner layer 5 in a helical orientation. The outer layer 16 contains twelve strands 17 wrapped around the middle layer in a helical orientation. The helical wrapping of each layer may be co-laid or vary in degree and direction from that of the preceding layer. In terms of degree, the helical angle of each layer may vary from 5 to 35°. Helix angle is determined using the following formula:

$$\tan HA = \frac{\pi \times p}{L}$$

where:

HA=helix angle

=pitch diameter

L=lay length

In one embodiment, the lay of the helical angle for each layer is in a right-hand direction and the degree of the wrapping is 20°. In one embodiment, the helix angle of each layer is different and each layer has the same lay length.

Figure 2A:
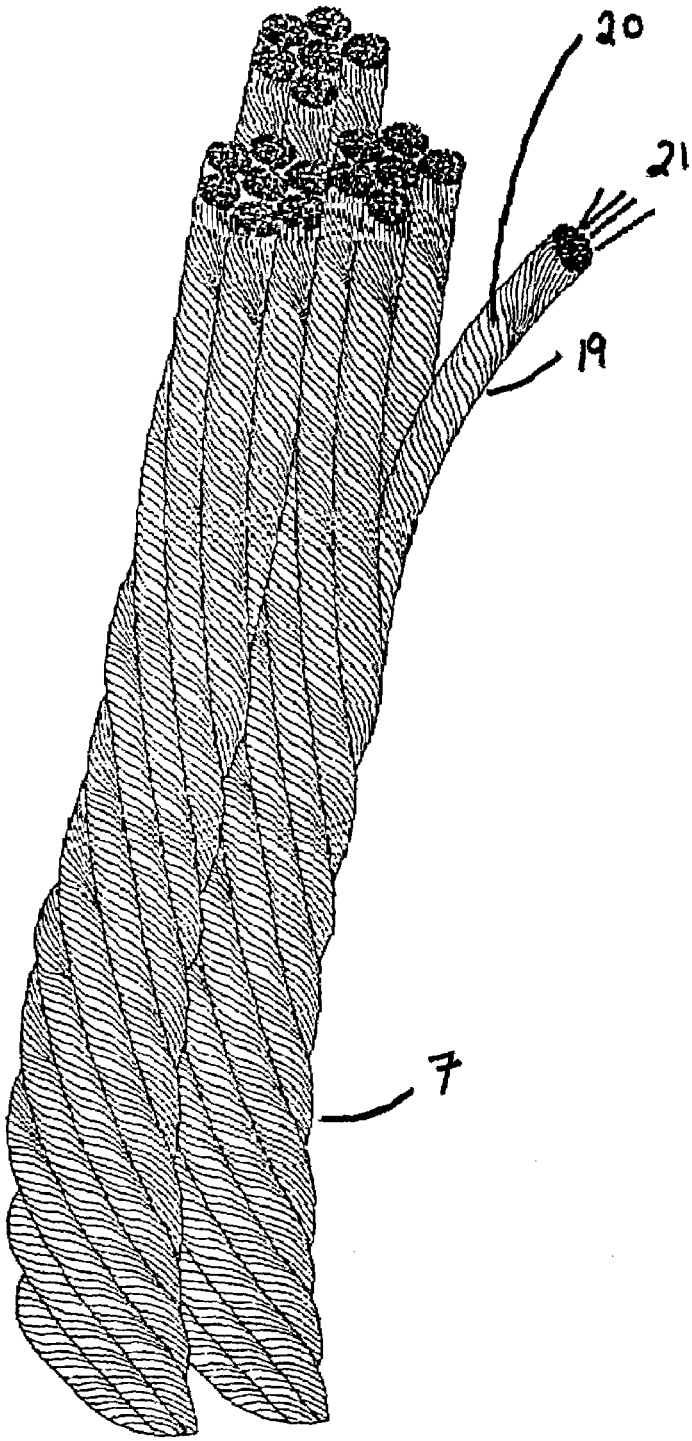
FIG. 2A is an enlarged perspective view showing an embodiment of the inner layer of three strands making up the rope of FIG. 1, and further shows one of the substrands deflected out of alignment.

FIG. 2A is an enlarged perspective view of one embodiment of the inner layer 5 of three strands shown in FIG. 1. In this embodiment, seven pre-twisted substrands 19 comprise each strand 7 of the inner layer. FIG. 2A also shows one of the substrands 19 deflected out of alignment from the other substrands to show the construction of the strand 7 from its component substrands 19, yarns 20 and filaments 21.

Figure 2B:
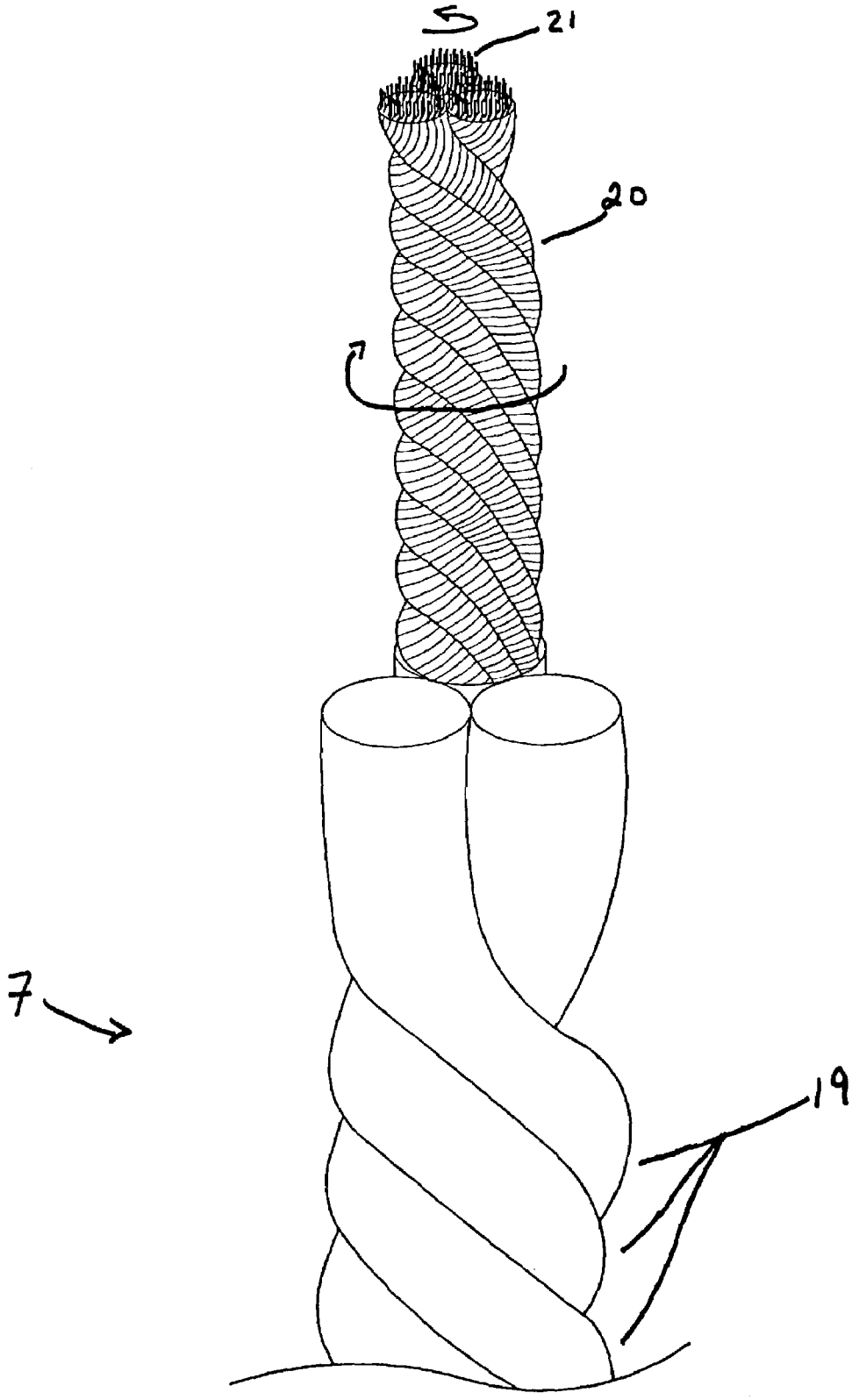
FIG. 2B is an enlarged perspective view of a strand according to the invention made from three pre-twisted substrands, each of which is made from three yarns composed of synthetic filaments.

FIG. 2B shows an enlarged perspective view of a different embodiment of one strand 7 in the inner layer, and shows one of the pre-twisted substrands 19 in greater detail. In FIG. 2B, strand 7 is constructed from three pre-twisted substrands 19. Each substrand 19 is formed as follows. Three yarns 20 are individually formed from a multiplicity of continuous filaments 21. Each yarn 20 is twisted about its longitudinal axis at between 1 and 6 turns per inch (tpi), and preferably between 2 and 4 tpi, in a counterclockwise direction (denoted by the smaller arrow). The three twisted yarns 20 are then twisted together at the same number of turns per inch in a clockwise direction (denoted by the larger arrow). Alternatively, substrands 19 can be formed in a single twisting step by twisting together all yarns in the substrand in a clockwise direction at between 1 and 6 tpi, and preferably between 2 and 4 tpi. The amount of turns per inch in the twisting will vary proportionately smaller or larger depending on the diameter of the particular yarns, substrands, and strands being constructed. In the lower portion of FIG. 2B, the three substrands 19 are shown in cylindrical outline (for example, as more clearly shown in FIG. 2A). However, all three substrands in this embodiment arc formed in the same manner, that is, by the twisting of multifilament yarns, and there is no sheathing of any of the substrands 19.

As shown in FIG. 2B, three pre-twisted substrands 19 are then helically laid around one another to form each strand 7. Each strand for each layer may be formed in the same manner, or may have a different degree of twist, or be composed of varying numbers of pre-twisted substrands or varying number of multifilament yarns of filaments. The degree of the pre-twisting may vary and is preferably from 5 to 45°.

The yarns can be of any high strength, high modulus, low creep fiber, including but not restricted to, polyamide fibers, polyolefin fibers, polybenzoxazole fibers, and polybenzothiazole fibers, or mixtures thereof. Preferably, the fibers are made of polyamide. When the polymer is polyamide, para-aramid is preferred, such para-aramid sold under the trademark KEVLAR® and more preferably KEVLAR® 29 or KEVLAR® 49 (KEVLAR is a trademark of E. I. du Pont de Nemours and Company).

In one embodiment, the strands of the middle layer 11 and outer layer 16 are also constructed of pre-twisted substrands. The pre-twisting of substrands prevents undue compression of the substrands, for example when the rope 1 passes over the drive sheave of a traction elevator. By counteracting the compression that would otherwise occur, the pre-twisted construction of substrands of the rope 1 lengthens the overall service life of the rope.

Figure 4:
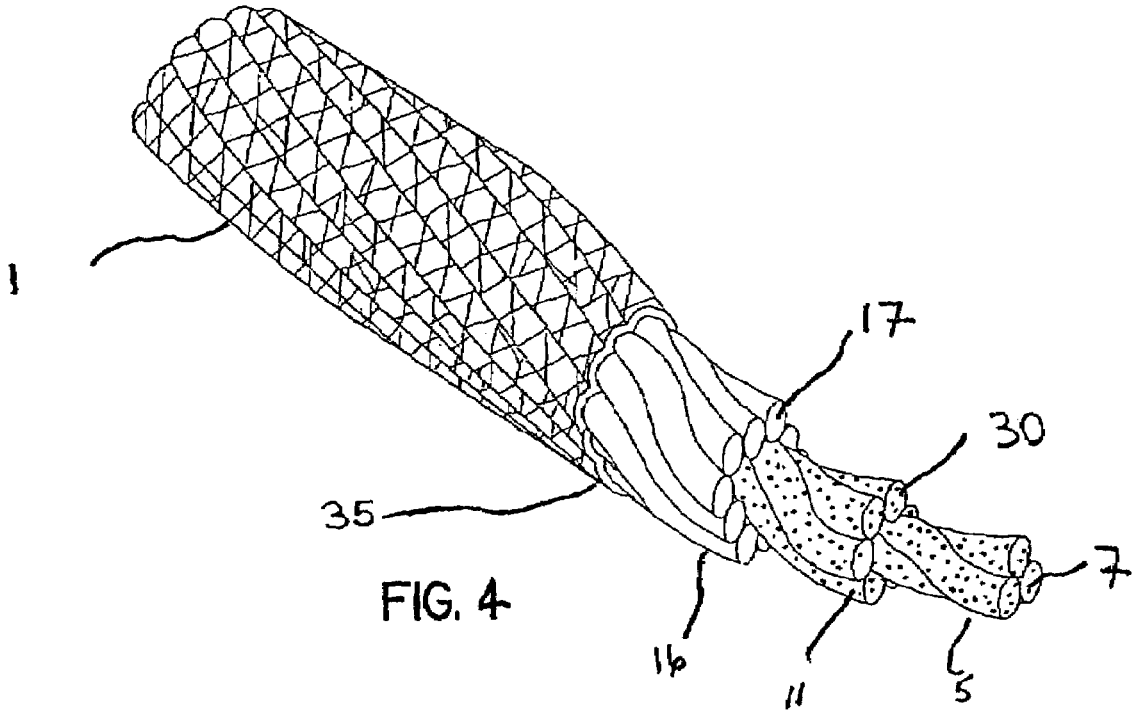
FIG. 4 is the rope of FIG. 1 showing the inner and middle layers impregnated with a dried particle lubricant of polytetrafluoroethylene.

The inner and middle layers, 5 and 11 (corresponding to strands 7 and 13) may be impregnated with a lubricant to prevent abrasion of the strands with other strands. The strands may be impregnated by dipping the layers into a dispersion of a polytetrafluoroethylene (PTFE), such as TEFLON® (a trademark of E. I. du Pont de Nemours and Company), and then drying the dispersion. Once dry, the PTFE forms into fine particles 30 (see FIG. 4) impregnating the strands. It is envisioned that during the life of the rope 1, the fine particles 30 of PTFE will not migrate from inner and middle layers, 5 and 11, to the outer layer 16. Alternatively, any of the strands of the rope 1 may be impregnated with the dispersion of PTFE as they are formed to eliminate a separate dipping step.

An exterior jacket 35 may be applied over the outermost layer 16 of strands. The exterior jacket 35 is typically formed of nylon or a polyester material. The exterior jacket is preferably braided into a crosshatch pattern. In a particular embodiment, the jacket is composed of CORDORA® nylon fibers.

Imperial dimensioned ropes of ¼", ⅜", ½", ⅝", ¾", and metric dimensioned ropes of 6, 8, 9, 10, 11, 12, 13, 14, 15, 16, 12, 20, and 22 mm diameter, are envisioned, although any diameter rope which would be suitable for a particular application may be prepared.

Figure 5A:
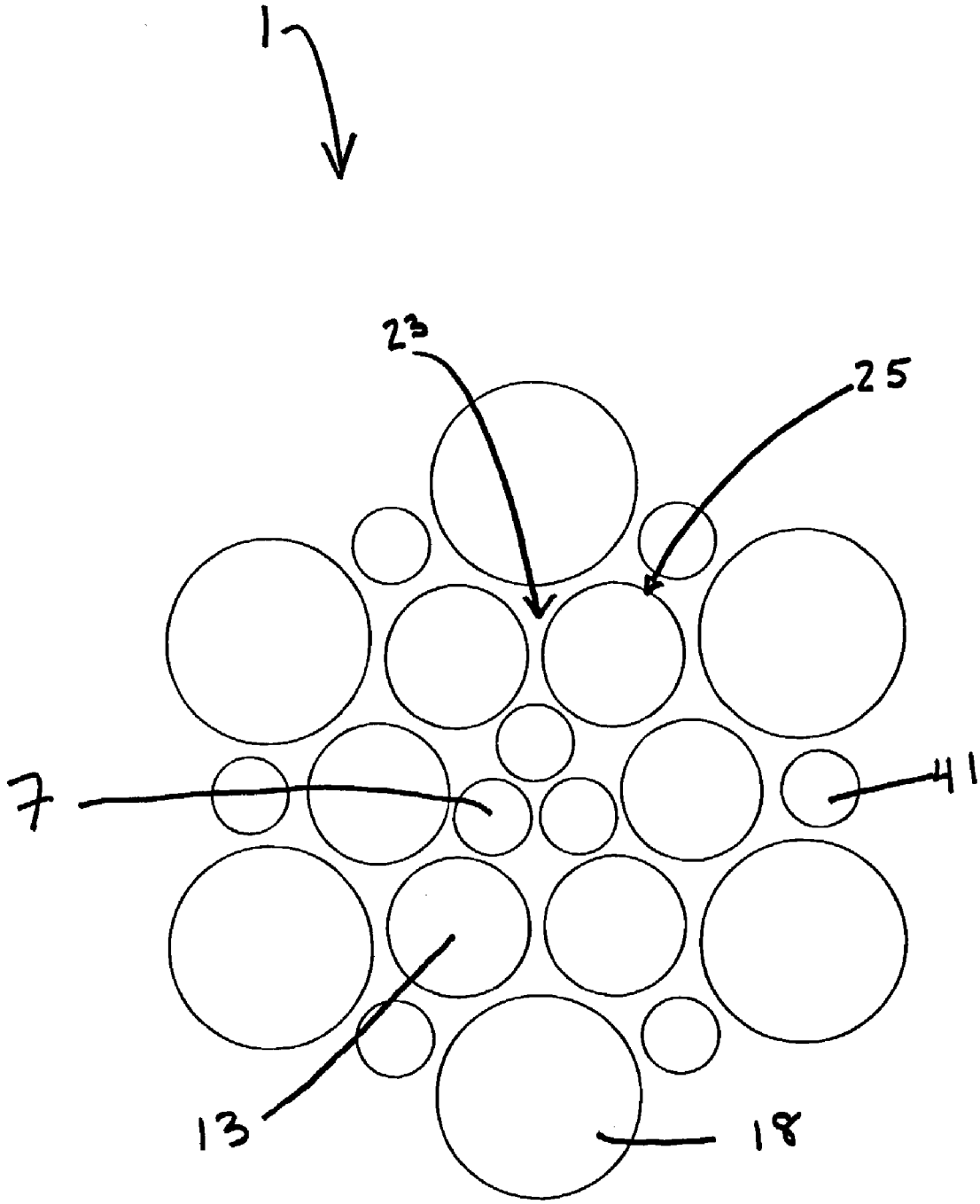
FIG. 5A is a cross section of one embodiment of the rope showing outer layer strands alternatingly of two different cross sections.
Figure 5B:
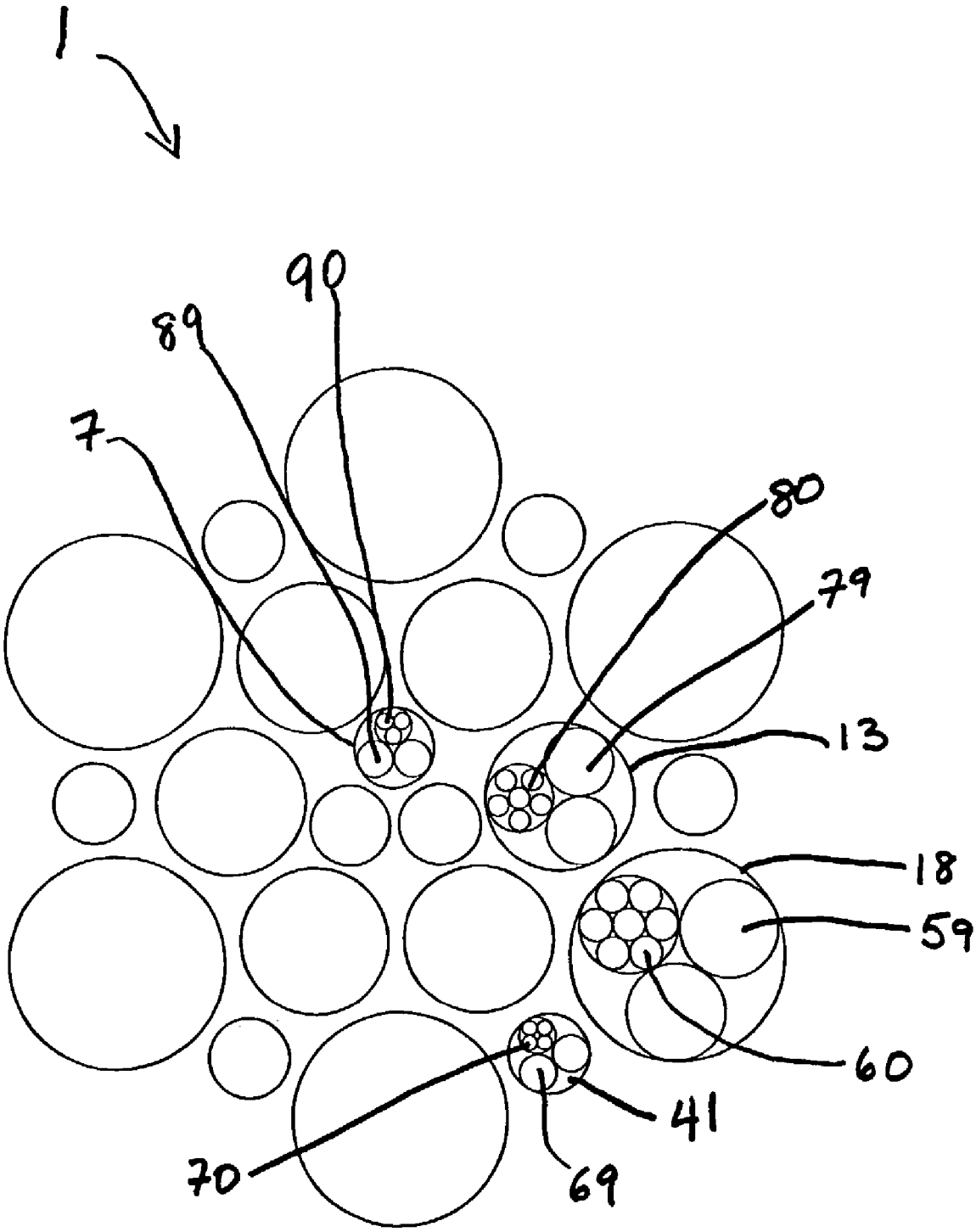
FIG. 5B is a cross section of the embodiment shown in FIG. 5A with greater detail showing the yarns forming particular substrands, which form the strands of the rope.

In another embodiment depicted in FIGS. 5A and 5B, the strands of outer layer 16 comprise first strands 18 having a first diameter or cross section and second strands 41 having a second diameter or cross section that is shorter or smaller than that of the first strands 18. The two sets of strands 18, 41 alternate in position around the strands 13 of the middle layer 11. Larger diameter strands 18 fit within cusps 23 between strands 13 of middle layer 11. Smaller diameter strands 41 are positioned adjacent to crowns 25 of each of the strands 13. Each strand 7, 13, 18, and 41 comprises a plurality of pretwisted substrands 20.

In one preferred embodiment, the rope 1 has a 0.5 inch diameter and comprises twelve strands in the outer layer 16, six strands in the middle layer 11, and three strands in the inner layer 5. The twelve strands in the outer layer 16 comprise six larger strands 18 and six smaller strands 41. As shown in FIG. 5B, each of the larger strands 18 is made of three substrands 59. Each substrand 59 has a denier of 21000. Each substrand 59 is formed from seven yarns 60. Each yarn 60 is a single multifilament yarn formed from aramid fibers, rather than a pair of yarns twisted together. This is represented by the designation 3000/1/7. Using the same designating system, each of the six smaller strands 41 in the outer layer is made of three substrands 69 and each substrand 69 is formed from four yarns 70 and is represented by the designation 3000/1/4. Each of the six strands 13 in the middle layer is made of three substrands 79 and each substrand is formed from six yarns 80, and is represented by the designation 3000/1/6. Each of the three strands 7 in the inner layer is made of three substrands 89 and each substrand 89 is formed from three yarns 90, and is represented by the designation 3000/1/3. In each substrand, each yarn is individually twisted in one direction and all three or more twisted yarns are then plied together by twisting in the opposite direction to form the substrand. Strands are then formed from three identically constructed substrands by helically twisting them together in the same direction like that done to form the substrands. The rope 1 is formed by conventional rope laying techniques, whereby the three strands 7 are first helically laid to form the inner layer 5, the six strands 13 are laid over the inner layer 5 to form the middle layer 11, and then the six strands 18 and six strands 41 are laid over the middle layer to form the outer layer 16. The exterior of the rope is then covered by an outer braided CORDURA® nylon fiber jacket for providing traction with a drive sheave.

In another embodiment, the rope 1 has a diameter of 0.375 inch and is comprised of two, rather than three layers of strands (as in the 0.5 inch rope previously described). The outer layer has six strands, and the inner layer has three strands. Each of the six strands in the outer layer is made of three substrands. Each of the three substrands has a denier of 19880. Each substrand has seven multifilament yarn pairs. Each yarn pair is twisted together and called a ply. This is represented by the designation 1420/2/7 (yarn denier/number of yarns per ply/number of plies per substrand).

Each of the three strands in the inner layer is made of three substrands and each such substrand, using the same designating system, is represented by the designation 1420/2/5. In each substrand, each two yarn pair is twisted together in one direction, and five or more twisted yarn pairs are then plied together by twisting in the opposite direction to form the substrand. Strands are then formed from three identically constructed substrands by helically laying them together in the same direction as that used to form the substrands. The rope is formed by conventional rope laying techniques, whereby the three inner layer strands are first helically laid to form the inner layer and then the six outer layer strands are helically laid over the inner layer to form the outer layer. The exterior of the rope may be covered by a jacket, such as an outer braided CORDURA® nylon fiber jacket for providing traction with a drive sheave.

Ropes made in accordance with the invention were tested to measure their initial characteristics and physical properties over the course of an expected service life. Cyclic-bend-over-sheave-fatigue tests were carried out to obtain AE values for the rope. In this regard, the "AE" value is used as a measure of the stiffness of the rope, and is defined as the cross-sectional area multiplied by Young's modulus of elasticity. In these tests, ropes of the invention (formed from aramid fibers and having diameter of 0.5") were placed over sheaves (typically about 10" diameter) placed under tension of 1000–2000 lbs and then subjected to a number of bending cycles (ranging from 250,000–3,000,000) having a cycle period of about 2–5 seconds. AE values were taken at several different bending cycles.

The AE values of the rope range from 680,000 to 2,900,000, with a typical AE of 980,000. In comparison, the AE of steel rope of the same 0.5 inch diameter is about 550,000. The data indicates that a significantly smaller cross-sectional area (and thus a narrower and ultimately lighter rope) can be used to obtain the same properties as a steel rope. The initial breaking strength of ropes of the invention was at least 25,000 lbs. Further test results indicate that the ropes of the invention retain a substantial amount of the breaking strength and should have about two times the life of steel ropes. Unlike steel ropes, the synthetic ropes of the invention are also particularly advantageous in that they do not require periodic lubrication, do not rust, and actually can increase in coefficient of friction if exposed to water.

Figure 3:
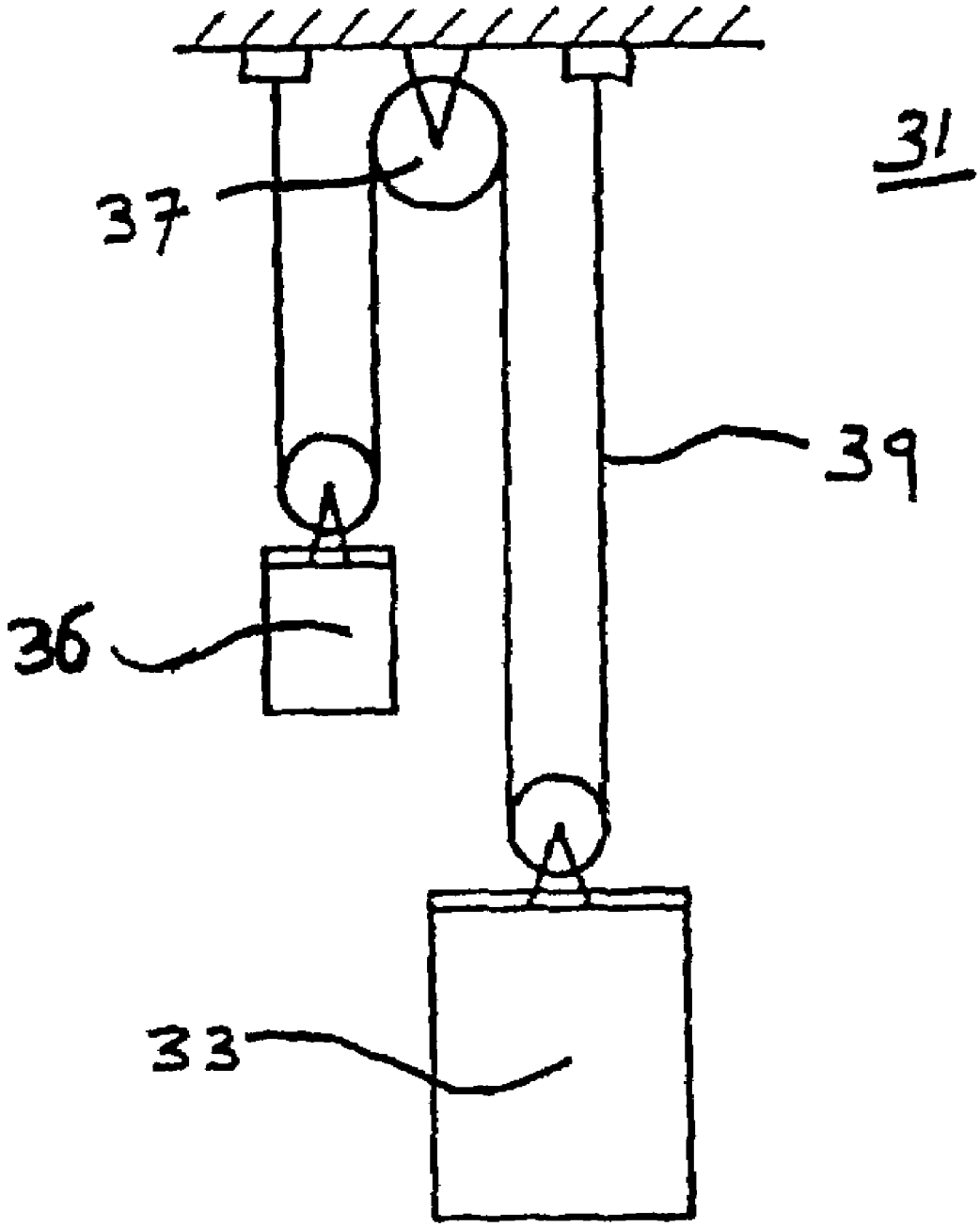
FIG. 3 is a view of an elevator system comprising a rope according to the invention.

FIG. 3 shows another aspect of the claimed invention, wherein the rope of the invention is incorporated within an elevator system. The elevator system 31 includes an elevator car 33, a counterweight 36, a drive sheave 37, and a drive motor. A rope 39 according to the invention is used to move the car 33 within the elevator system.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. A rope for an elevator comprising:

an inner layer of three strands laid helically around one another;

a middle layer of six strands laid helically around the inner layer; and an outer layer of twelve strands laid helically around the middle layer;

wherein each strand comprises a plurality of pre-twisted substrands, each substrand comprising a plurality of yarns twisted together, wherein each yam is twisted about its longitudinal axis in a first direction, and the plurality of yams are twisted about each other in a second direction to form each pre-twisted substrand, and wherein the yams comprise high modulus synthetic filaments.

2. A rope for an elevator according to claim 1, wherein the synthetic filaments comprise polyamide filaments, polyolefin filaments, polybenzoxazole filaments, polybenzothiazole filaments, or mixtures thereof.

3. A rope for an elevator according to claim 1, wherein the synthetic filaments comprise aramid filaments.

4. A rope for an elevator according to claim 1, wherein the first direction and the second direction are opposite.

5. A rope for an elevator according to claim 1, wherein the first direction and the second direction are the same.

6. A rope for an elevator according to claim 1, wherein at least one layer further comprises a lubricant in one or more of the strands of the layer.

7. A rope for an elevator according to claim 6, wherein the lubricant comprises particles of polytetrafluoroethylene.

8. A rope for an elevator according to claim 1, wherein the yams comprise KEVLAR® aramid filaments.

9. A rope for an elevator according to claim 8, wherein the KEVLAR® aramid filament comprises KEVLAR® 29 filaments or KEVLAR® 49 filaments.

10. A rope for an elevator according to claim 9, having a diameter in the range of% inch to 1 inch.

11. A rope for an elevator according to claim 10, wherein the initial breaking strength of a half inch diameter rope is greater than about 25,000 lbs.

12. A rope for an elevator according to claim 1, further comprising an exterior jacket comprising nylon or a woven polyester.

13. A rope for an elevator according to claim 12, wherein the exterior jacket is woven in a Crosshatch pattern.

14. A rope for an elevator according to claim 1, wherein the yarns are individually twisted at between 1–6 turns per inch in a counterclockwise direction.

15. A rope for an elevator according to claim 14, wherein the plurality of yams are twisted together to form the substrand at between 1–6 turns per inch in a clockwise direction.

* * * * *

UNITED STATES PATENT AND TRADEMARK OFFICE

CERTIFICATE OF CORRECTION

PATENT NO. : 7,032,371 B2
APPLICATION NO. : 10/354378
DATED : April 25, 2006
INVENTOR(S) : Rory S. Smith et al.

It is certified that error appears in the above-identified patent and that said Letters Patent is hereby corrected as shown below:

Column 6, Claim 1, Line 67, after, "...wherein each" please remove "yam" and insert --yarn…--

Column 7, Claim 1, Line 2, after "...plurality of" please remove "yams" and insert --yarns…--

Column 7, Claim 1, Line 4, after "...wherein the" please remove "yams" and insert --yarns…--

Column 7, Claim 8, Line 22, after "...wherein the" please remove "yams" and insert --yarns…--

Column 8, Claim 10, Line 5, after "...range of" please insert a space.

Column 8, claim 15, Line 18, after "...plurality of" please remove "yams" and insert --yarns…--

Signed and Sealed this

Seventh Day of November, 2006

JON W. DUDAS
*Director of the United States Patent and Trademark Office*